US007217397B1

(12) United States Patent
Astle

(10) Patent No.: US 7,217,397 B1
(45) Date of Patent: May 15, 2007

(54) PRECIOUS REAGENT CONTAINER AND METHOD OF USE

(76) Inventor: Thomas W. Astle, 607 Harborview Rd., Orange, CT (US) 06477

( * ) Notice: Subject to any disclaimer, the term of this patent is extended or adjusted under 35 U.S.C. 154(b) by 665 days.

(21) Appl. No.: 10/212,655

(22) Filed: Aug. 5, 2002

(51) Int. Cl.
*B01L 3/00* (2006.01)

(52) U.S. Cl. ..... 422/102; 117/206

(58) Field of Classification Search ..... 422/102; 117/206, 901
See application file for complete search history.

(56) References Cited

U.S. PATENT DOCUMENTS 5,399,317 A * 3/1995 Stolowitz ..... 422/99
6,149,872 A * 11/2000 Mack et al. ..... 422/102
6,890,488 B2 * 5/2005 Mathus et al. ..... 422/99
6,921,660 B2 * 7/2005 Kirk et al. ..... 435/287.2
2002/0164824 A1 * 11/2002 Xiao et al. ..... 436/524
2003/0044324 A1 * 3/2003 Micklash et al. ..... 422/102

* cited by examiner

*Primary Examiner*—Jill Warden
*Assistant Examiner*—Natalia Levkovich
(74) *Attorney, Agent, or Firm*—John H. Crozier

(57) ABSTRACT

In a preferred embodiment, a precious reagent container, including; a horizontally elongated body; a plurality of vertical, aligned reagent wells defined in the body, the reagent wells having a common depth; and a common vertical channel joining the vertical, aligned reagent wells, the common vertical channel having a depth equal to the common depth. A method of using the precious reagent container is also provided.

10 Claims, 2 Drawing Sheets

PRECIOUS REAGENT CONTAINER AND METHOD OF USE

BACKGROUND OF THE INVENTION

1. Field of the Invention

The present invention relates to reagents generally and, more particularly, but not by way of limitation, to novel precious reagent container and method of use.

2. Background Art

In the field of drug discovery and genomic research, there is a need to work with small aliquots of precious reagents. A problem arises when it is necessary to work with them in high throughput applications. To meet the throughput desired in this area of work, the microplate is the de facto standard in either 96 well format or 384 well format. The 96 well format consists of wells in an 8×12 matrix on 9 mm spacing. The 384 well format is a 16×24 matrix on 4.5 mm spacing. The newest configuration to consume reagents is the 1536 well format of a 32×48 matrix on 2.5 mm spacing.

The size of the precious liquid aliquot to be transferred is normally in the range of 0.5 to 5 microliters. This is easily accomplished with the multiple well pipettors that are available. A problem arises, however, in trying to fill the multiple pipettor tips. Normally, a reservoir is used to permit multiple well pipettors to aspirate aliquots simultaneously for dispensing. Assume 5 μL of reagent A is to be aspirated and dispensed to all wells of a 384 well microplate. This requires 1920 μL or 1.92 mL total volume. The wells of the pipettor are spread over an area of 72×108 mm or 7776 $mm^2$. That equates to 4 μL for every square millimeter of the reservoir bottom. Surface tension alone prohibits that small a volume from uniformly covering that area.

The solution most commonly used is to have individual small grooves or channels defined in the bottom of the reservoir. Then, instead of trying to cover the entire area, it is only necessary to have enough reagents to fill the channels to a suitable depth to aspirate the required volume. Another approach is to have small dimples located under each aspirating well. Theoretically, the dimples could hold the volume desired for each aspirating well. The problem reverts to how is each dimple filled. If done individually, the advantage of multiple well pipetting is lost. To fill all dimples essentially simultaneously, a small volume may be placed in the reservoir and the reservoir is then shaken or vibrated to cause liquid motion to fill the dimples.

In all cases, there is a dead volume that cannot be aspirated with the multiple well pipettor. There is a loss when this dead volume is returned to the source or storage container. This loss and the need for extra reagent to fill the dead volume inhibit the use of multiple well pipettors.

Accordingly, it is a principal object of the present invention to provide a container that can be used as both a storage unit and a reservoir for multiple well pipetting, with essentially no dead volume as described above.

It is a further object of the invention to provide such a container that can be stored at temperatures of −20° C. to −80° C.

It is an additional object of the invention to provide such a container that can be easily filled.

It is another object of the invention to provide such a container that can be easily manufactured using conventional techniques.

It is yet a further object of the invention to provide a method of using such a container.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a precious reagent container, comprising; a horizontally elongated body; a plurality of vertical, aligned reagent wells defined in said body, said reagent wells having a common depth; and a common vertical channel joining said vertical, aligned reagent wells, said common vertical channel having a depth equal to said common depth. A method of using said precious reagent container is also provided.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Figure 1:
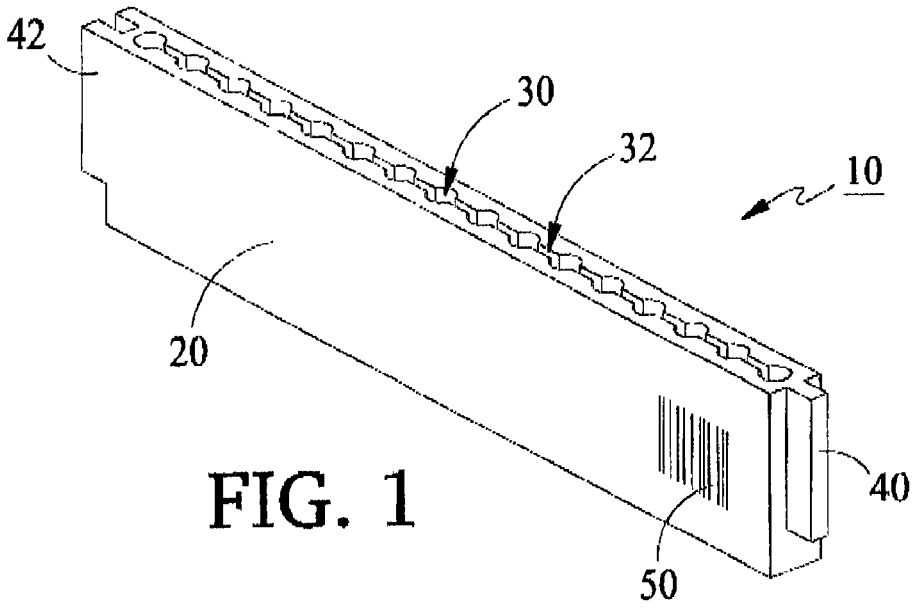
FIG. 1 is a top/side/end isometric view of a reagent container according to the present invention.

Reference should now be made to the drawing figures on which similar or identical elements are given consistent identifying numerals throughout the various figures thereof, and on which parenthetical references to figure numbers, when used, direct the reader to the view(s) on which the element(s) being described is (are) best seen, although the element(s) may be seen on other figures also.

FIG. 1 illustrates a regent container, constructed according to the present invention, and generally indicated by the reference numeral 10. Reagent container 10 includes a horizontally extending body 20 that can be injection molded from an inert polymer that is suitable for storage at temperatures of −20° C. to −80° C. Injection molded polypropylene is an example of a suitable polymer. It may also be molded from fluoropolymers to provide different liquid surface tension characteristics. Defined in body 20 is a plurality of aligned vertical wells, as at 30, joined by a vertical channel 32. In the embodiment shown, there are 16 wells 30 on 4.5 mm spacing, each well with a diameter of about 0.12-inch×about 0.42-inch deep. The width of channel 32 is about 0.030 inch wide×0.38-inch deep. The height of body 20 is 0.560 inch to match the recommended height of a standard microplate, per the Society of Biomolecular Screening (SBS) standard. The total brim volume of wells 30 and channel 32 is approximately 1.3 mL. A first end of body 20 has a male tang 40 to interlock with a supporting frame (not shown on FIG. 1) for alignment and a second end of body 20 has a female receptacle 42 to mate with a male tang on the frame.

Male tang 40 and female receptacle 42 serve to provide orientation of reagent container 10. This provides two functions: first, male tang 40 and female receptacle 42 maintain the orientation of an identifying bar code 50 (shown on the side of body 20, but more conveniently placed on the bottom of the body) and, second, they allow making companion strips in other than sixteen contiguous wells (i.e., two sets of eight or four sets of four), thus providing added flexibility to the design. A 2-D bar code may also be provided. Reagent container 10 may be accessed individually by an eight or a sixteen well pipettor. The eight well pipettor would have a 9 mm spacing, while the sixteen well pipettor would have a 4.5 mm spacing.

Figure 2:
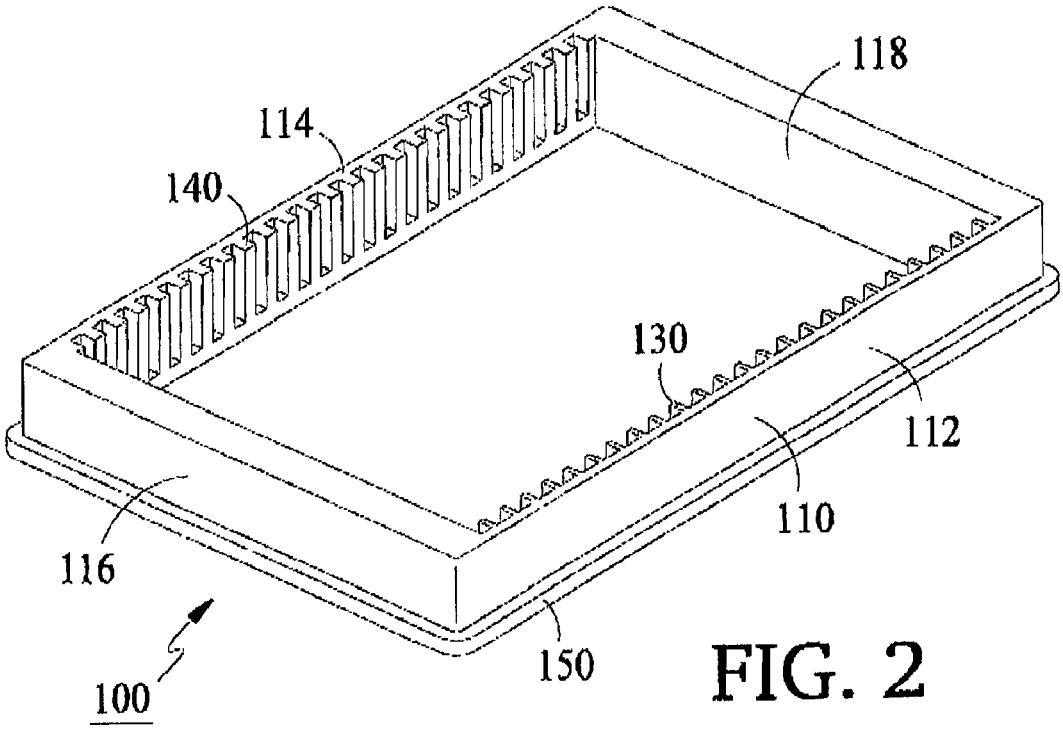
FIG. 2 is a top/side/end isometric view of a frame that can be used to hold a plurality of reagent containers.

FIG. 2 illustrates a frame, constructed according to the present invention, and generally indicated by the reference numeral 100. Frame 100 has an open bottom, horizontal, rectangular body 110, with end walls 112 and 114 and side walls 116 and 118. End wall 112 has a plurality of male tangs formed thereon, as at 130, to engage a female receptacle 42 (FIG. 1) and end wall 114 has a plurality of female receptacles, as at 140, formed thereon to engage a male tang 40 (FIG. 1). Frame 100 has a footprint of 5.030 inches long× 3.365 inches long to match the SBS standard for microplates. Frame 100 also has flanges 150 defined along the lower edges of ends 112 and 114 and sides 116 and 118 to permit the use of the frame in plate stackers.

Figure 3:
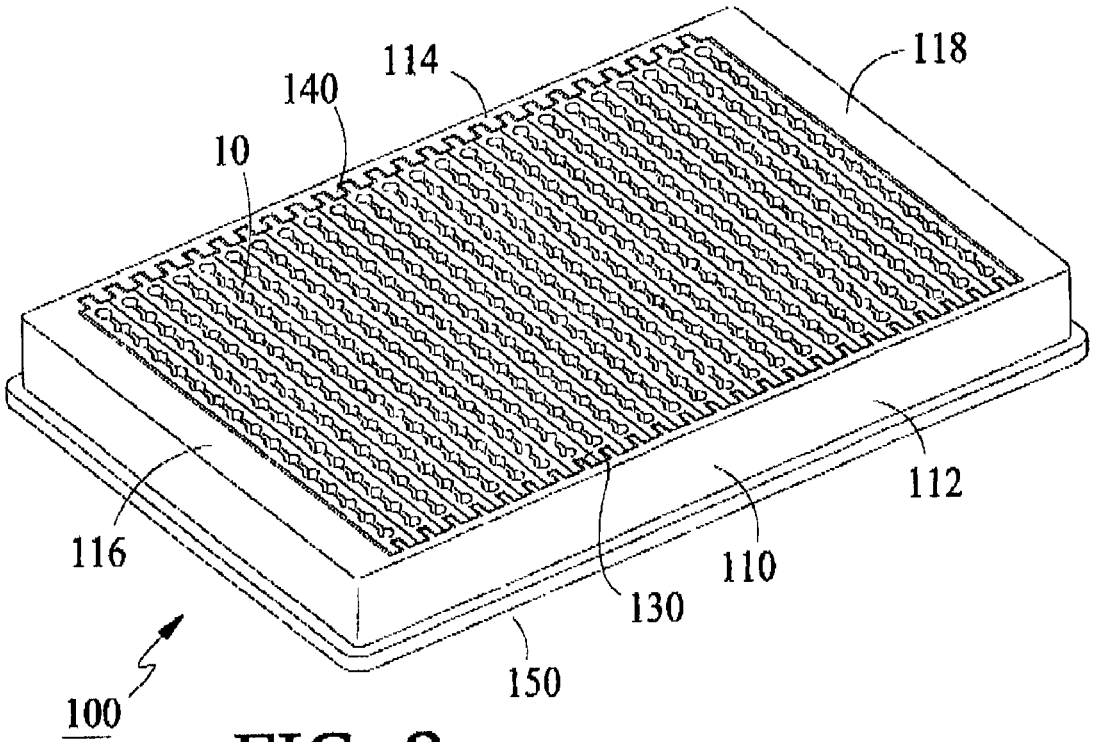
FIG. 3 is a top/side/end isometric view of a frame with a plurality of reagent containers therein.

FIG. 3 illustrates frame 100 filled with reagent containers, as at 10. Thus arranged, wells 130 of reagent containers 10 could be accessed simultaneously with a 384 well pipettor.

Figure 4:
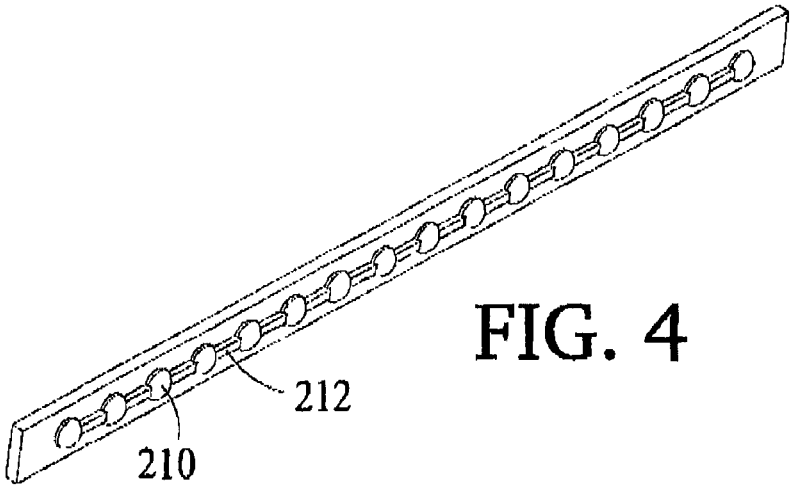
FIG. 4 is a bottom/side/end elevational view of a lid for a container.

FIG. 4 illustrates a cover 200 that can be used to close wells 30 and channel 32 (FIG. 1). Downwardly protruding dimples, as at 210, and downwardly protruding strips 212 joining the dimples fill the tops of wells 30 and channel 32, respectively, thus closing them to the surrounding environment Cover 200 may be manufactured from a flexible low durometer polymer, such as ethylene vinyl acetate or copolymers thereof.

In use, each reagent container 10 (FIG. 1) is filled with its reagent. Low viscosity aqueous reagents may be filled from one point. The liquid reagent will, flow through connecting channel 32 to be evenly distributed to all wells. Viscous reagents may have to be filled in several wells and then centrifuged or vibrated to obtain uniform filling. Cover 200 (FIG. 4) is then pressed into place on the top of the filled strip. The filled and sealed reagent container 10 is now ready for storage at ambient or below ambient temperatures. Reagent containers 10 may be stored individually or in frame 100 (FIG. 3) as microplates.

At the time of use, container 10 is retrieved from storage and cover 200 removed. Container 10 may be used singularly or aligned within frame 100. Then, the pipettor being used would aspirate the required volume. Cover 200 is replaced and the remaining balance of the reagent is returned to storage. Channel 32 ensures that the level in each well 30 is the same as the liquid reagent is removed. Being able to pipette directly from the storage container greatly reduces waste of precious reagent.

In the embodiments of the present invention described above, it will be recognized that individual elements and/or features thereof are not necessarily limited to a particular embodiment but, where applicable, are interchangeable and can be used in any selected embodiment even though such may not be specifically shown.

Terms such as "above", "below", "upper", "lower", "inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction and method without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

The embodiments of the invention in which an exclusive property or privilege is claimed are defined as follows:

1. A precious reagent container, comprising;

(a) a horizontally elongated body;

(b) at least sixteen vertical, aligned vertical reagent wells defined in said body, said reagent wells having a common depth; and (c) a common vertical channel joining said reagent wells, said common vertical channel having a depth equal to said common depth and said common vertical channel connecting said aligned vertical reagent wells in a single horizontal line, the depth of the aligned vertical wells and common channel being much greater than the width of the aligned vertical wells and common channel.

2. A precious reagent container, as defined in claim 1, wherein: said horizontally elongated body is 4.5 mm wide.

3. A precious reagent container, as defined in claim 1, wherein: said at least sixteen aligned vertical reagent wells are round and each is about 0.090-inch diameter by about 0.50-inch deep.

4. A precious reagent container, as defined in claim 1, wherein: said common vertical channel is about 0.030-inch wide by about 0.50-inch deep.

5. A precious reagent container, as defined in claim 1, wherein: said precious reagent container is arranged side-by-side in a frame with additional precious reagent containers, so as to make the completed assembly of reagent containers and frame to physically meet footprint and standard height dimensions of a microplate, as established by the Society of BioMolecular Screening.

6. A precious reagent container, as defined in claim 1, further comprising: male and female orientation features disposed, respectively, on first and second ends of said precious reagent container to force a common orientation when said at least three precious reagent containers are mounted together.

7. A precious reagent container, as defined in claim 1, wherein: said horizontally elongated body has a bar code thereon for automated reading and identification.

8. A precious reagent container, as defined in claim 1, wherein: said horizontally elongated body is manufactured by an injection molding process using polymers suitable for storage at temperatures of about −80° C.

9. A precious reagent container, as defined in claim 1, further comprising: a lid to seal said at least sixteen aligned vertical reagent wells.

10. A precious reagent container, as defined in claim 9, wherein: said lid has a plurality of downwardly formed dimples, each one of which said downwardly formed dimples can be pressed into a top of one of said at least sixteen aligned vertical reagent wells to effectively close contents of said at least sixteen aligned vertical reagent wells to surrounding environment.

* * * * *